US008789920B2

(12) United States Patent
Asano

(10) Patent No.: US 8,789,920 B2
(45) Date of Patent: Jul. 29, 2014

(54) INKJET APPARATUS

(75) Inventor: Shinya Asano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 256 days.

(21) Appl. No.: 12/965,441

(22) Filed: Dec. 10, 2010

(65) Prior Publication Data

US 2012/0001983 A1 Jan. 5, 2012

(30) Foreign Application Priority Data

Jul. 1, 2010 (JP) ..... 2010-151172

(51) Int. Cl.
*B41J 2/165* (2006.01)

(52) U.S. Cl.
USPC ..... 347/36

(58) Field of Classification Search
None
See application file for complete search history.

(56) References Cited

U.S. PATENT DOCUMENTS

2009/0189965 A1* 7/2009 Koike et al. ..... 347/102

FOREIGN PATENT DOCUMENTS

| | | | |
|---|---|---|---|
| JP | S39-028986 | Y | 10/1964 |
| JP | 06-277431 | A | 10/1994 |
| JP | 08-066610 | A | 3/1996 |
| JP | 2000-189739 | A | 7/2000 |
| JP | 2004-276381 | A | 10/2004 |
| JP | 2005-152687 | A | 6/2005 |
| JP | 2006-26620 | A | 2/2006 |
| JP | 2006-205566 | A | 8/2006 |
| JP | 2007-111397 | A | 5/2007 |
| JP | 2006-199044 | A | 8/2007 |
| JP | 2007-229950 | A | 9/2007 |
| JP | 2008-80495 | A | 4/2008 |
| JP | 2008-114509 | A | 5/2008 |
| JP | 2010-105273 | A | 5/2010 |
| JP | 2010-131511 | A | 6/2010 |

* cited by examiner

*Primary Examiner* — Alejandro Valencia
(74) *Attorney, Agent, or Firm* — Canon U.S.A., Inc., IP Division

(57) ABSTRACT

An inkjet apparatus having a liquid container configured to contain liquid, a conduit configured to discharge gas in a first space where an inkjet head is placed into the liquid contained in the liquid container, and a pump configured to discharge the gas from a second space over the surface of the liquid in the liquid container is provided. If the pump is operated, the second space is placed in a reduced pressure condition as compared to the first space, and the gas in the first space is discharged into the liquid through the conduit, thereby becomes bubbles, and floats up.

8 Claims, 12 Drawing Sheets

INKJET APPARATUS

BACKGROUND OF THE INVENTION

1. Field of the Invention

The present invention relates to an inkjet apparatus provided with an ink mist collection mechanism.

2. Description of the Related Art

Japanese Patent Application Laid-Open No. 2008-80495 discusses an inkjet apparatus provided with a mist collection mechanism for controlling scatter of ink mist generated from an inkjet head. The mist collection mechanism sucks in gas in the apparatus and traps the ink mist with a fine filter made of a porous member, a mesh member, etc. The filter is clogged with the trapped ink mist, and accordingly the filter is configured to be replaceable regularly.

Although a subject field is different from the inkjet apparatus field, Japanese Patent Application Laid-Open No. 2006-26620 discusses a liquid filter for trapping oil mist in gas. The gas is blown into liquid and is allowed passage through the liquid as bubbles to cause the oil mist in the gas to be dissolved in the liquid so as to remove the oil mist in the gas.

In the mechanism discussed in Japanese Patent Application Laid-Open No. 2008-80495, resistance in passing the gas through the filter gradually increases as the filter clogging progresses. Then, the suction power of the gas, that is, the performance of the ink mist collection is declining. Therefore, in order to maintain the performance of the ink mist collection, maintenance operation of filter replacement is regularly required.

To improve the filter performance, for example, the liquid filter discussed in Japanese Patent Application Laid-Open No. 2006-26620 can be used. In the technique in Japanese Patent Application Laid-Open No. 2006-26620, the liquid filter is configured to blow pressured gas compressed by a compressor and an air tank into a solution. Thus, while the gas containing suspended mist passes through the compressor and the air tank, the mist adheres to the inside, and the clogging accumulates. As a result, maintenance such as disassembly and cleaning is required in a short cycle. Especially, the air compressor has a complicated structure and it is not easy to disassemble and clean up the air compressor. Accordingly, it disturbs practical use of the filter if the air compressor becomes unusable in a short period.

SUMMARY OF THE INVENTION

The present invention is directed to an inkjet apparatus provided with a mist collection mechanism that can trap ink mist and other foreign materials suspended in gas at a high efficiency and free from maintenance for long periods. The present invention can be applied to inkjet apparatuses for performing a variety of processing operations such as recording, processing, application, exposure, reading, tests, etc. on a medium. In the specification, the medium means an object on which ink can be applied. The material of the medium is not limited to a specific material, for example, paper, plastic, film, fabric, metal, and flexible boards can be employed.

According to an aspect of the present invention, an inkjet apparatus having a liquid container configured to contain liquid, a conduit configured to discharge gas in a first space where an inkjet head is placed, into the liquid contained in the liquid container, and a pump configured to discharge the gas from a second space over the surface of the liquid in the liquid container is provided. If the pump is operated, the second space is placed in a reduced pressure condition as compared to the first space, and the gas in the first space is discharged into the liquid through the conduit, thereby becomes bubbles, and floats up.

According to exemplary embodiments of the present invention, the pump is not provided in the conduit from the first space that is the generation source of the ink mist or the other foreign materials, to the liquid container containing the liquid. Accordingly, the ink mist and the foreign materials do not accumulate in the pump in a short period, which realizes maintenance-free operation of the pump for long periods. Further, even if the ink mist dissolves in the liquid, elevation of the liquid level is very little. Thus, basically, discharge or replacement of the liquid is not necessary, and the liquid is free from maintenance for long periods. As described above, the inkjet apparatus that can trap the ink mist and the other foreign materials suspended in the gas at a high efficiency and is free from maintenance for long periods can be provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
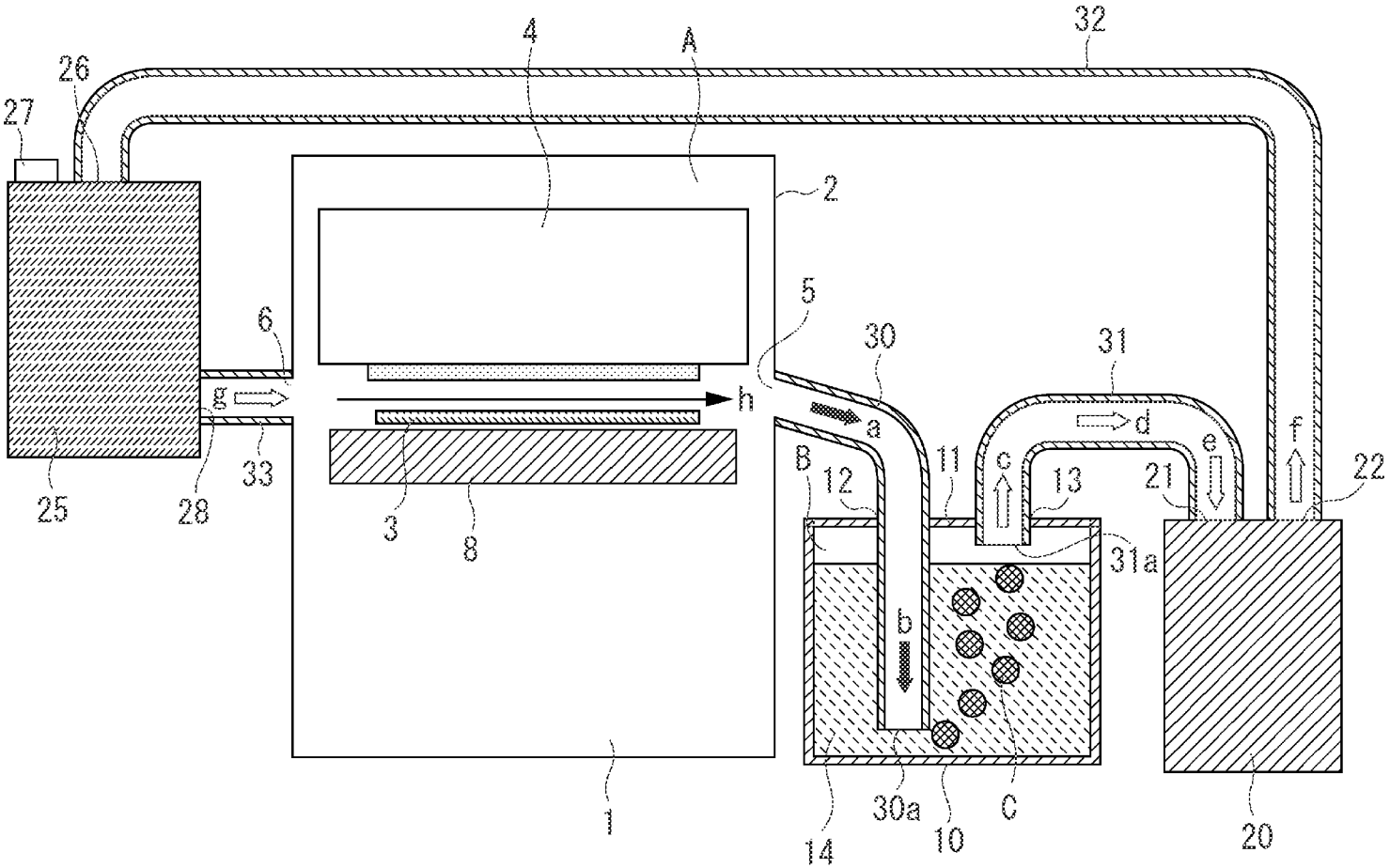
FIG. 1 illustrates a configuration of an inkjet apparatus according to an exemplary embodiment of the present invention.

FIG. 1 illustrates a configuration of an inkjet apparatus according to the exemplary embodiment of the present invention. The overall configuration includes main components of a recording unit 1 having an inkjet head 4, a liquid container 10 containing liquid, a pump 20, and a humidification unit 25.

The recording unit 1 includes a housing 2 that is substantially sealed. The housing 2 provides a space A (first space) that houses a recording unit having the inkjet head 4 and a platen 8 that supports a medium 3. On the side of the housing 2, an outlet 5 for discharging gas in the space A and an inlet 6 for introducing humidified gas into the space A are provided. The inkjet head 4 has many nozzles formed to discharge ink. In the exemplary embodiment, the inkjet method employs a method using a heating element. However, the inkjet method can employ methods using a piezoelectric element, an electrostatic element, a Micro Electro Mechanical System (MEMS) element, or the like. To the inkjet head 4, ink is supplied from an ink supply unit (not shown) such as an ink tank.

The liquid container 10 holds liquid 14 therein. In the exemplary embodiment, the liquid 14 is water. However, the liquid 14 is not limited to the water, any liquid that dissolves ink, for example, the ink itself can be used. Space B (second space) existing above the liquid level of the liquid 14 is a closed space covered with a lid 11. An input aperture 12 and an output aperture 13 is arranged on the lid 11.

The pump 20 is a suction pump for discharging gas from the space B above the liquid level of the liquid in the liquid container 10. The pump 20 includes an inlet 21 of gas and an outlet 22 for discharging the sucked gas. As long as the pump 20 has the function to suck in gas, any types of pumps such as positive displacement pumps, non-positive displacement (turbo type) pumps, and pumps generating airflow with a fan can be employed.

The humidification unit 25 generates humidified gas at a predetermined humidity and temperature to supply the gas inside the housing 2. The humidification unit 25 includes an inlet 26 for introducing circulating gas, an inlet 27 for introducing outside air, and an outlet 28 for discharging humidified gas.

Each of the above-described units is connected with each other by conduits that serve as circulation channels of the gas. Preferably, each of the conduits is made of such a tube which is not easily deformed due to application of pressure or reduction in pressure and yet is flexible. The housing 2 and the liquid container 10 are connected with each other by a conduit 30 (first flow passage). The one end of the conduit 30 is connected to the outlet 5 of the housing 2 and the other end part 30*a* of the conduit 30 is introduced into the liquid container 10 through the input aperture 12 of the lid 11, and opens in the vicinity of the bottom of the liquid. More specifically, by the conduit 30, the gas in the space of the housing 2 is discharged into the liquid at a position lower than the liquid level in the liquid container 10. The shape of the conduit 30 has no horizontal part and an ascending part with respect to the direction of gravitational force and the conduit 30 descends from the outlet 5 to the input aperture 12 where the conduit 30 is connected to the liquid container 10.

The liquid container 10 and the pump 20 are connected with each other by a conduit 31 (second flow passage). An end part 31*a* of the conduit 31 is introduced in the liquid container 10 through the outlet 13 of the lid 11, and opens in the space B over the surface of the liquid in the liquid container 10. The other end part of the conduit 31 is connected to the inlet 21 of the pump 20. When the gas in the space B of upper part of the liquid container 10 is sucked in by the pump 20, the space B is placed in a reduced pressure condition (also referred to as a negative pressure condition).

The pump 20 and the humidification unit 25 are connected with each other by a conduit 32 (third flow passage) that is a return conduit. The one end of the conduit 32 is connected to the outlet 22 of the pump 20, and the other end of the conduit 32 is connected to the inlet 26 of the humidification unit 25. Outside air is also introduced from the inlet 27 to the humidification unit 25.

The humidification unit 25 and the housing 2 are connected with each other by a conduit 33 (fourth flow passage). The one end of the conduit 33 is connected to the outlet 28 of the humidification unit 25, and the other end of the conduit 33 is connected to the inlet 6 of the housing 2. The humidified gas generated in the humidification unit 25 is introduced into the housing 2 through the conduit 33.

As described above, each unit is connected by the conduits, and forms the system as a whole in which the gas circulates. In the exemplary embodiment, the gas is the air. However, gas different from the air can be employed.

In the configuration, if the pump 20 is operated, the gas is sucked in from the conduit 31 (arrow c, arrow d, and arrow e), the space B in the liquid container 10 is placed in reduced pressure condition as compared to the space A. Then, a differential pressure (relative atmospheric pressure difference) is generated between the space A in the housing 2 and the space B in the liquid container 10. Due to the differential pressure, the gas in the space A in the housing 2 is introduced through the conduit 30 (arrow a, and arrow b). The introduced gas is discharged into the liquid 14 and becomes many small bubbles C. The bubbles C float up, and move to the space B. In the present exemplary embodiment, the space A is under atmospheric pressure. However, the space A can be in a positive pressure condition or a negative pressure condition compared to atmospheric pressure. In such a case, similarly to the above, by the operation of the pump 20, the space B in the liquid container 10 is placed in a reduced pressure condition as compared to the space A, and a differential pressure is to be generated.

In the recording unit 1, ink mist which is fine ink particles generated while recording onto the medium 3 is performed with the inkjet head 4, and different from the original droplet (main droplet) is floating in the space A of the housing 2. Further, occasionally fine paper dust is generated from the medium 3 and floats. When the gas discharged from the space A is broken up into the bubbles C and the bubbles pass through in the liquid 14, most of the ink mist and the other foreign materials contained in the gas are absorbed and filtered in the liquid. More specifically, since the ink component easily dissolves in the water, the ink mist in the small bubbles dissolve in the liquid 14 around the bubbles. The fine materials such as the paper dust in the small bubbles are also trapped by the liquid 14 around the bubbles on the way floating up, or trapped on the surface of the liquid when the bubbles reach the surface of the liquid and break. As described above, the ink mist and the fine foreign materials in the gas are highly efficiently filtered by the liquid 14 that serves as the liquid filter. Even if the ink mist dissolves in the liquid, the liquid level increases very little. Therefore, basically, it is not necessary to discharge or replace the liquid, and maintenance-free operation for long periods is realized. As described above, the inkjet apparatus capable of highly effectively trapping the ink mist and the other foreign materials suspended in the gas and free from maintenance for long periods can be provided.

The outlet 5 of the housing 2 is arranged at higher position than the liquid level of the liquid 14 in the liquid container 10 in the direction of gravitational force. The input hole 12 through which the conduit 30 is introduced into the liquid container 10 is arranged to be located lower than the position of the outlet 5 in the direction of gravitational force. The conduit 30 has a shape descending from the position of the outlet 5 to the position (input hole 12) through which the conduit 30 is introduced into the liquid container 10 without a horizontal part and an ascending part. More specifically, in the conduit 30, the passage from the outlet 5 to the end part 30*a* is gradually descending in the direction of gravitational force. Due to above described configuration, the ink mist attached to the inner wall of the conduit 30 can flow down into the liquid container 10 by gravity, and does not flow back to the housing 2.

Since the gas in the space B in the liquid container 10 passed through the liquid 14, the humidity of the gas has been increased. Accordingly, the humidity of the gas discharged into the conduit 32 by the pump 20 is also high as compared to gas under a normal condition. The gas is introduced to the inlet 26 of the humidification unit 25 and used to generate humidified gas thereby increasing humidification efficiency of the humidification unit 25. That is, the excellent circulation system that helps to generate the humidified gas by circulating the gas passed through the liquid filter can be provided. It is also possible to introduce outside air from the inlet 27 to the humidification unit 25. In this case, the gas already humidified and the outside air is introduced from the inlet 26 in the unit at a desired mixture ratio.

The humidified gas introduced from the inlet 6 of the housing 2 flows a space between the nozzles of the inkjet head 4 and the supporting surface of the platen 8 in a predetermined direction (direction of arrow h), and the gas is discharged from the outlet 5. The outlet 5 is positioned near an ink mist generation source and at the downstream side of the flow of the humidified gas thereby reducing spread of the ink mist over a wide area in the housing 2, and discharging the ink mist efficiently. Further, the humidified gas flows near the nozzles of the inkjet head 4 and moisturizes the nozzles and ink of unused nozzles can be prevented from drying out.

Figure 2:
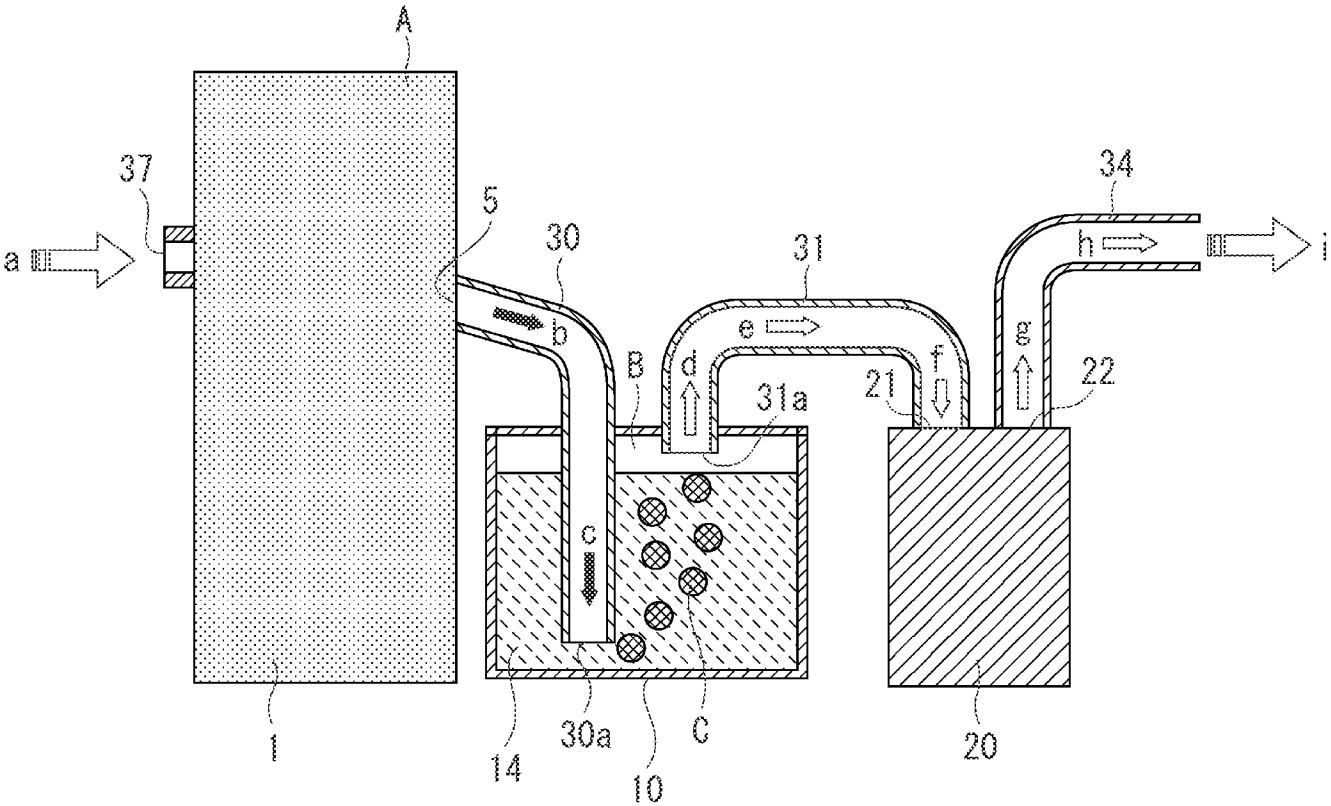
FIG. 2 illustrates a configuration of the inkjet apparatus according to another exemplary embodiment of the present invention.

In the present exemplary embodiment, the circulation system that circulates the gas discharged from the pump 20 and reuses the gas to generate the humidified gas is provided. If the humidification unit 25 has enough performance or the humidified gas itself is not necessary, the system can be a non-circulation system. FIG. 2 illustrates another exemplary configuration that does not include the humidification unit. In the recording unit 1, the space A of the housing includes the inkjet head, and the like similarly to FIG. 1. Outside air is introduced from an inlet 37 to the recording unit 1. Ink mist generated in the recording unit 1 is removed by a liquid filter similar to the above-described liquid filter, and discharged from the outlet 22 of the pump 20 to outside of the apparatus through a conduit 34 (arrow h, arrow i, and arrow j). Since the discharged gas is clean gas in which the ink mist and the foreign materials are filtered by the liquid filter, it is possible to prevent the ink mist from spreading in the installation environment of the apparatus.

Above-described exemplary embodiment includes the conduit 30 for discharging the gas in the space A where the inkjet head 4 is placed, into the liquid contained in the liquid container 10, and the pump 20 for discharging the gas from the space B above the liquid level in the liquid container 10. When the pump 20 is operated, the space B is placed in the reduced pressure condition. Then, the gas in the space A is discharged into the liquid 14 through the conduit 30, thereby becomes bubbles, and floats up. Since the pump is not provided in the conduit from the space A that is the generation source of the ink mist or the other foreign materials, to the liquid container, the ink mist or the other foreign materials do not accumulate in the pump in a short period. Accordingly, the maintenance-free operation of the pump for long periods is realized.

Figure 3:
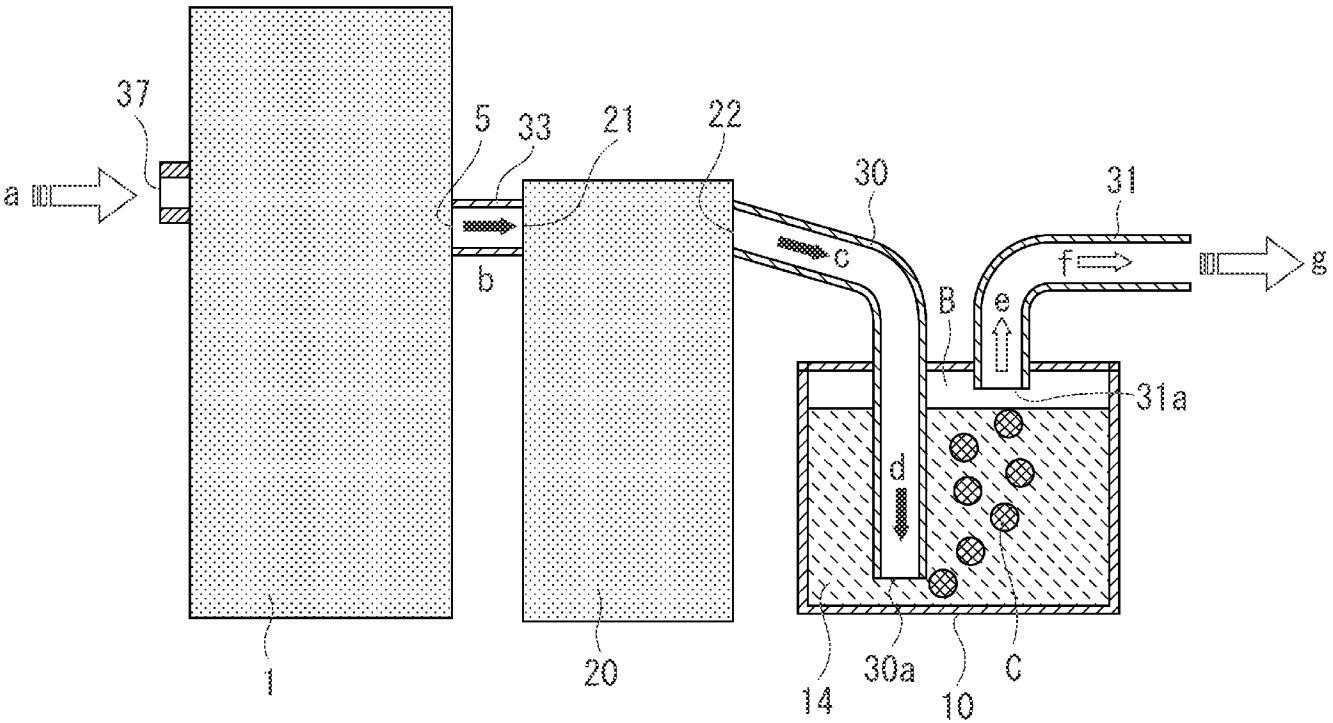
FIG. 3 illustrates a configuration of a comparative example.

As shown in FIG. 3 (comparative example), if the pump 20 is provided between the recording unit 1 and the liquid container 10, the gas containing a lot of suspended ink mist is sucked into the pump 20. As a result, the ink mist attaches to the inside of the pump 20, and the dust accumulates. Then, maintenance of the pump such as disassembly and cleaning is required in a short cycle. Since an air compressor has a complicated structure especially, and it is not easy to disassemble and clean up the air compressor it disturbs practical use of the filter if the air compressor becomes unusable in a short period.

Figure 4:
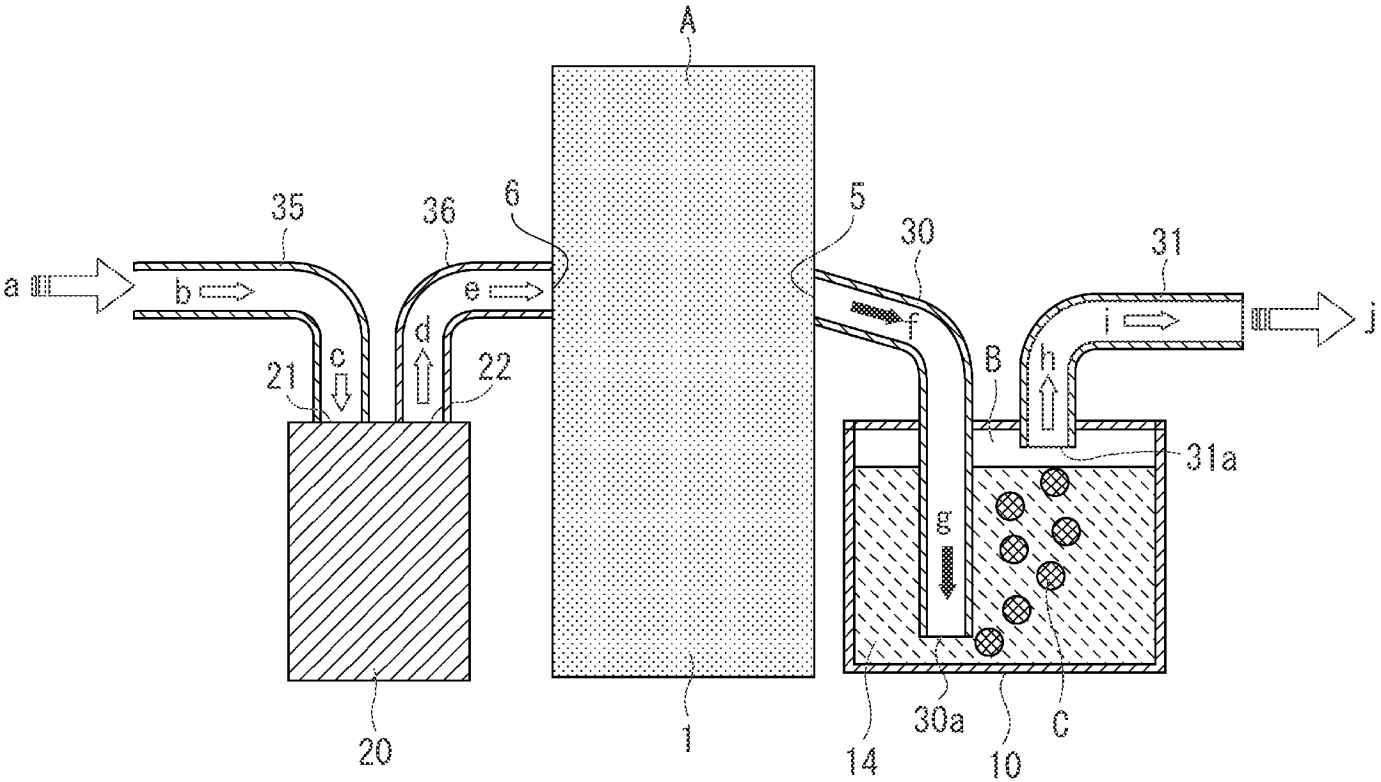
FIG. 4 illustrates a configuration of the inkjet apparatus according to yet another exemplary embodiment of the present invention.

FIG. 4 illustrates a configuration of yet another exemplary embodiment. As compared to the layout shown in FIG. 2, the pump 20 is placed before the recording unit 1. When the pump 20 is operated, outside air is introduced to the inlet 21 of the pump 20 through a conduit 35 (arrow a, arrow b, and arrow c). The gas discharged from the pump 20 is sent to the recording unit 1 from the outlet 22 through a conduit 36 (arrow d, and arrow e), and the space A in the housing of the recording unit 1 is in a pressurized condition (also referred to as positive pressure condition). On the other hand, the end of the conduit 31 connected to the space B in the liquid container 10 opens in the air and the space B is under atmospheric pressure. By the above configuration, a differential pressure is generated between the space A and the space B. Due to the differential pressure, the gas containing suspended ink mist in the space A is discharged into the liquid 14 through the conduit 30, and becomes many small bubbles C. The bubbles C float up, and move to the space B. When the bubbles float up, the ink mist and the foreign materials are absorbed and filtered by the liquid. The gas in the space B is discharged from the conduit 31 that opens in the air.

As described above, the configuration shown in FIG. 4 includes the conduit 30 for discharging the gas in the space A where the inkjet head 4 is placed into the liquid contained in the liquid container 10, and the pump 20 for introducing the gas into the space A. When the pump 20 is operated, the space A is placed in the pressurized condition. Then, similarly to the exemplary examples shown in FIG. 1 and FIG. 2, the gas containing the ink mist is discharged into the liquid 14 through the conduit 30, thereby becomes bubbles, and floats up. Since the pump is not provided in the conduit from the space A that is the generation source of the ink mist or the other foreign materials, to the liquid container, the ink mist or the other foreign materials do not accumulate in the pump in a short period. Accordingly, the maintenance-free operation of the pump for long periods is realized.

Next, other examples of the above-described liquid filter are described below. In each of the exemplary examples, the liquid container 10 has a structure for controlling the floating of the bubbles or for agitating the bubbles to reduce the size of the bubbles.

Figure 5:
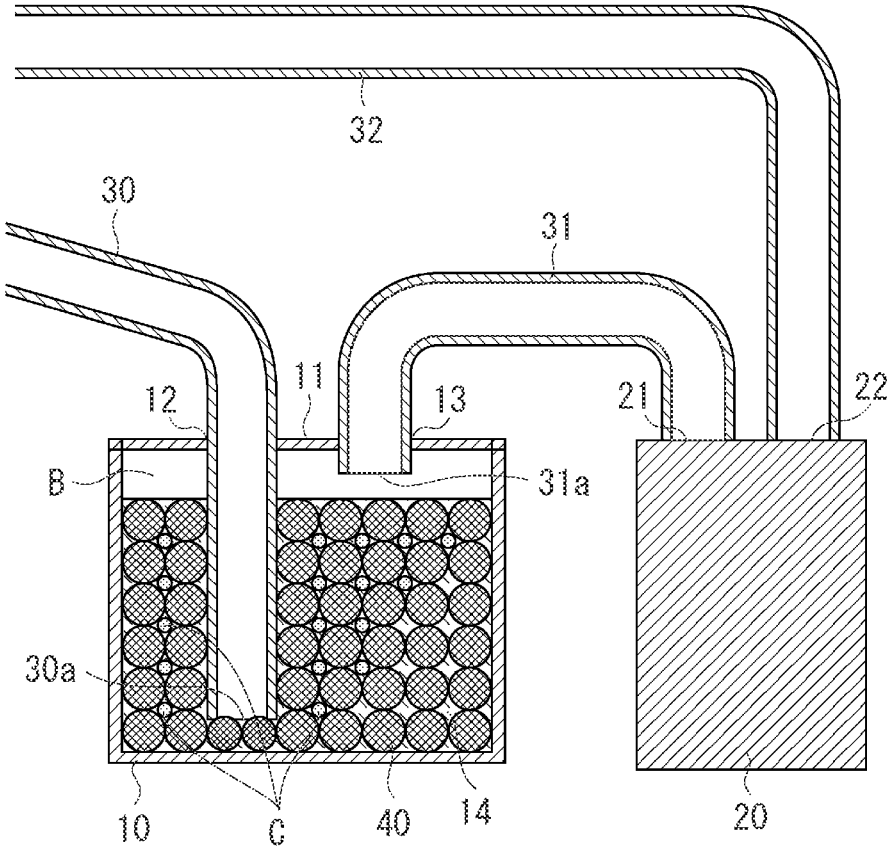
FIG. 5 illustrates an exemplary example of a specific configuration of a liquid filter.

FIG. 5 illustrates an example of the liquid filter. Water-insoluble solids, many small glass beads 40 in this exemplary example, are provided in the liquid 14 in the liquid container 10. The shape and the material of the solid is not limited to the above-mentioned example. The bubbles C discharged from the end part 30*a* of the conduit 30 are broken into smaller bubbles while passing through spaces between the glass beads 40 and floating up. The smaller the bubbles become, the higher a contacting rate of the liquid with the gas in the bubbles, thereby increasing the efficiency of the filter for trapping the ink mist or the foreign materials.

Figure 6:
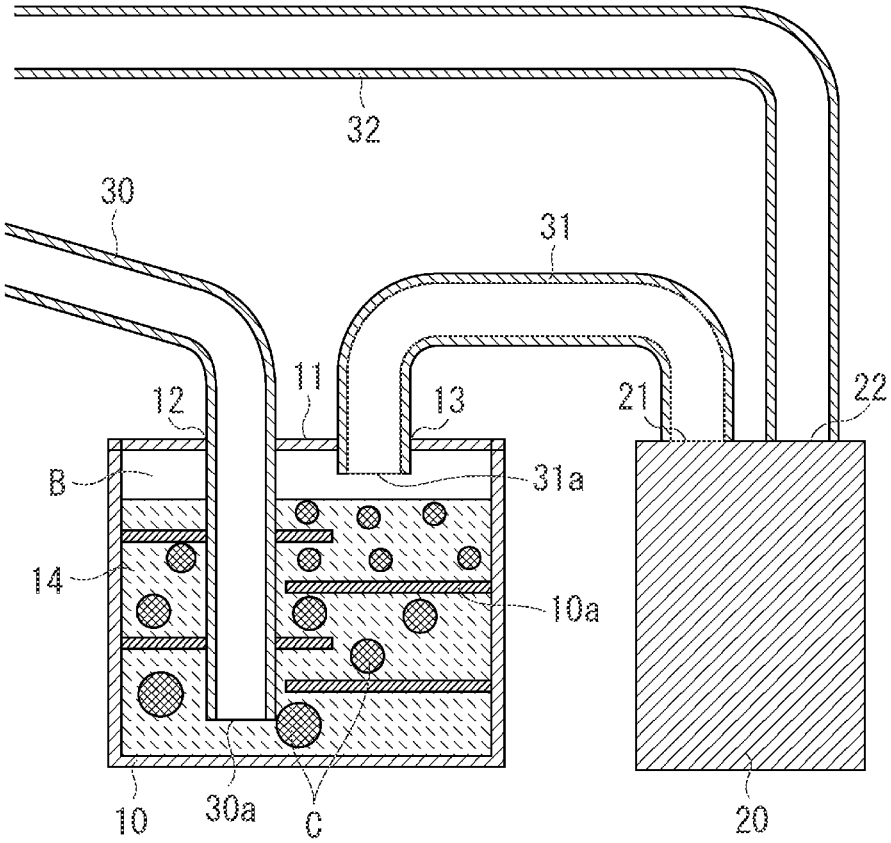
FIG. 6 illustrates another exemplary example of a specific configuration of a liquid filter.

FIG. 6 illustrates another exemplary example. On an inner wall of the liquid container 10, a plurality of projections 10*a*

(for example, ribs) are provided alternately in a plurality of steps on the floating path of the bubbles C. The bubbles C discharged from the end part 30*a* of the conduit 30 repeatedly collide with the projections while floating up and the bubbles are broken into small bubbles. By the above configuration, the efficiency of the filter for trapping the ink mist and the foreign materials increases.

Figure 7:
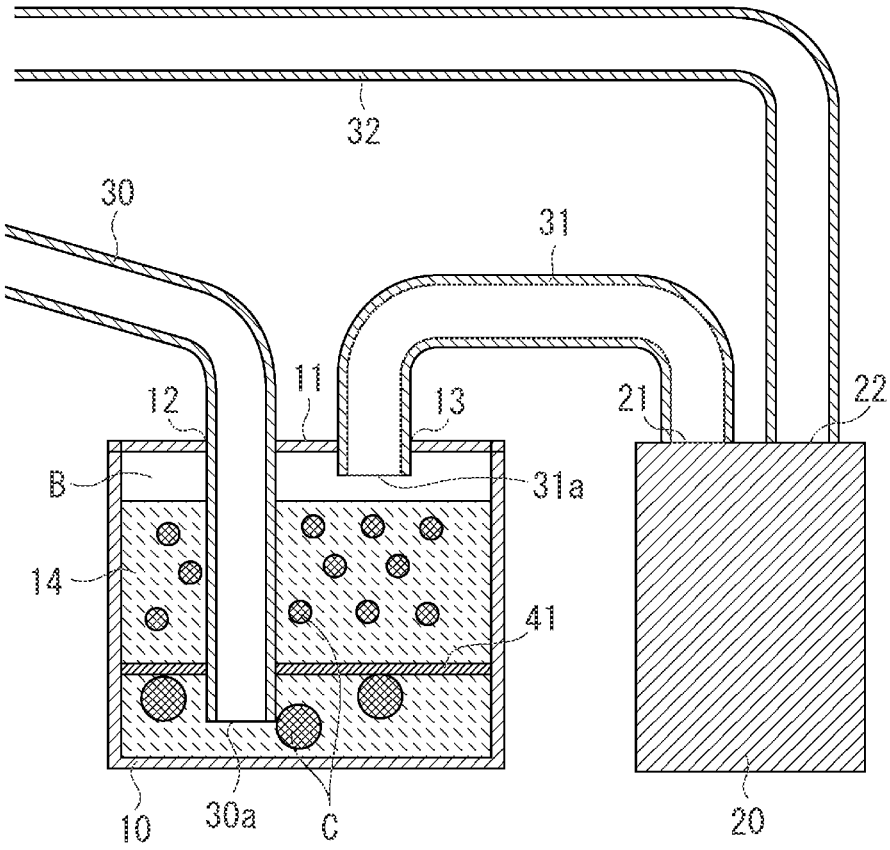
FIG. 7 illustrates yet another exemplary example of a specific configuration of a liquid filter.

FIG. 7 illustrates another example. In the vicinity of the bottom of the liquid 14 in the liquid container 10, a filter 41 is horizontally provided. The filter 41 is made of a porous member, a mesh member, etc, and the pitch of the mesh is smaller than the initial bubble size. The bubbles discharged from the end part 30*a* of the conduit 30 are broken into small bubbles by passing through the filter 41. By the above configuration, the efficiency of the filter for trapping the ink mist and the foreign materials increases.

Figure 8:
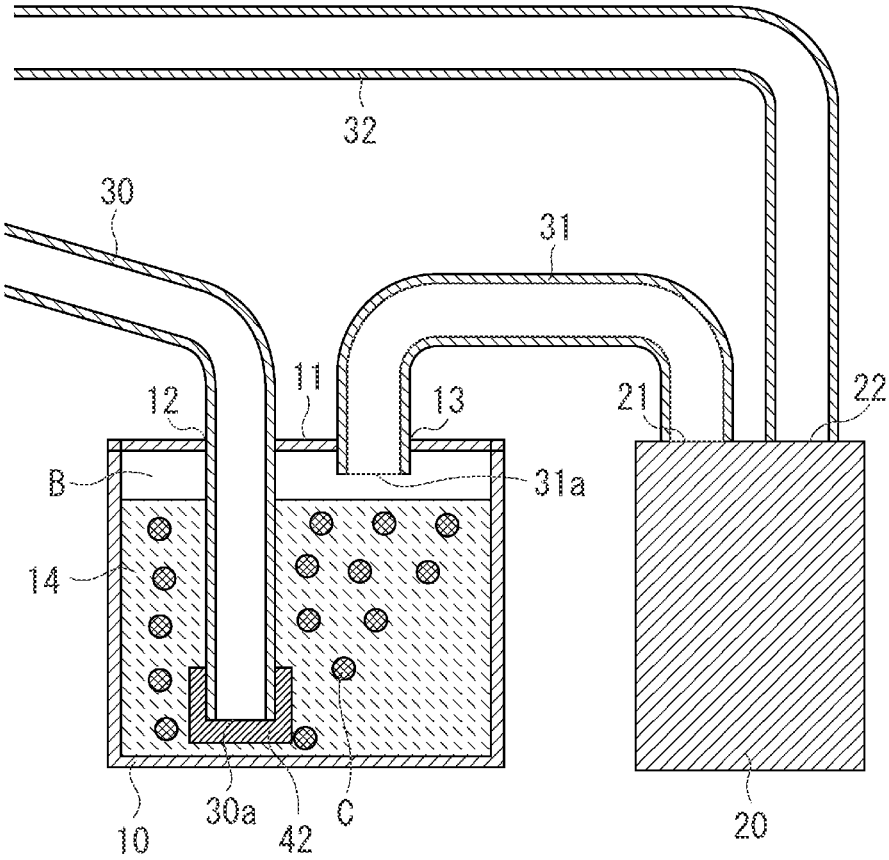
FIG. 8 illustrates further another exemplary example of a specific configuration of a liquid filter.

FIG. 8 illustrates another example. A filter 42 is attached to the end part 30*a* of the conduit 30. The filter 42 is made of a porous member, a mesh member, etc, and the pitch of the mesh is smaller than the initial bubble size. The bubbles discharged from the end part 30*a* of the conduit 30 are broken into small bubbles by passing through the filter 41. It is preferable to perform control such that the pump 20 operates only when the inkjet head 4 discharges the ink and ink mist is generated. When the pump 20 stops, the liquid flows into the inside of the conduit 30 further than the end part 30*a* of the conduit 30. Then, the liquid flows in the direction opposite to the direction when the pump 20 is in operation. By the above configuration, clogging of the filter 42 is reduced.

Figure 9:
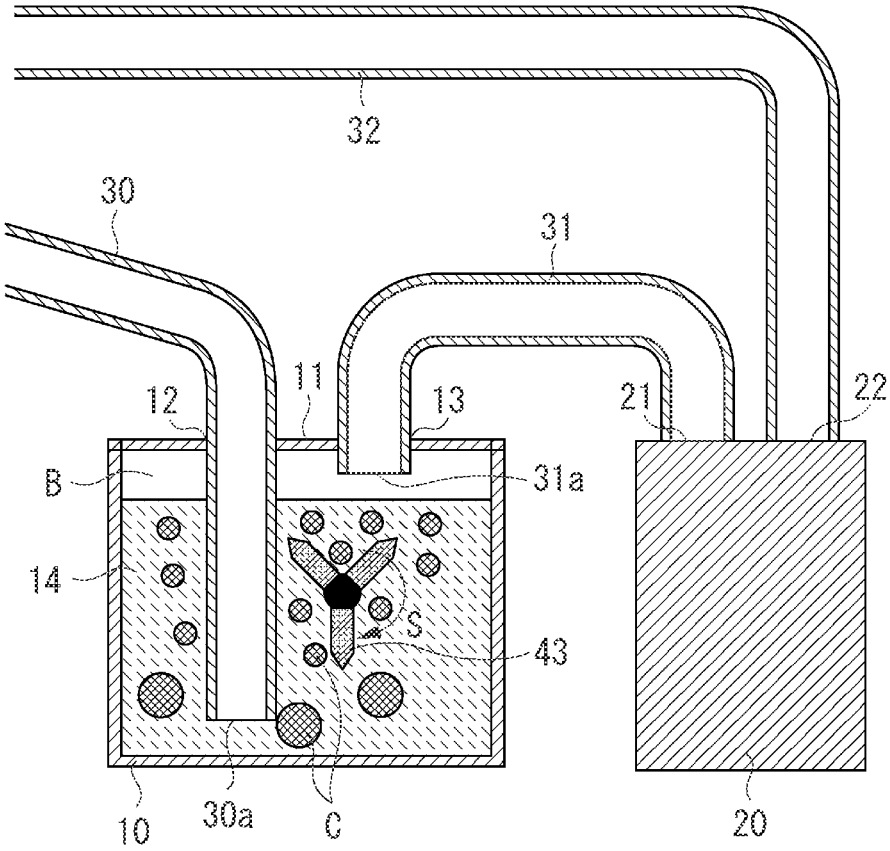
FIG. 9 illustrates still another exemplary example of a specific configuration of a liquid filter.

FIG. 9 illustrates another example. A structure to agitate the liquid 14, a rotatable agitation screw 43, for example, is provided in the liquid container 10. If the agitation screw 43 rotates in the direction of arrow S, a spiral water flow is generated. The bubbles C discharged from the end part 30*a* of the conduit 30 are broken into small bubbles by the whirlpool movement and direct hitting of the agitation screw 43. By the above configuration, the efficiency of the filter for trapping the ink mist and the foreign materials increases.

Figure 10A:
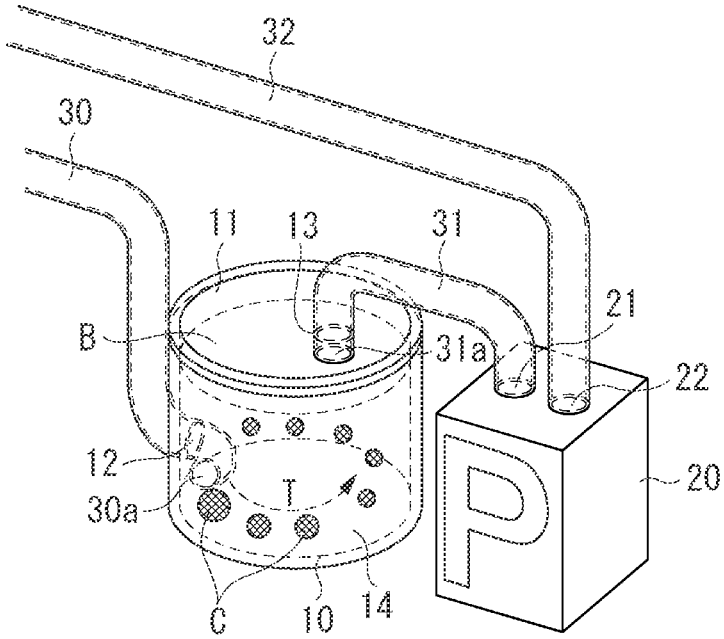
FIGS. 10A and 10B illustrate still other exemplary examples of a specific configuration of a liquid filter.
Figure 10B:
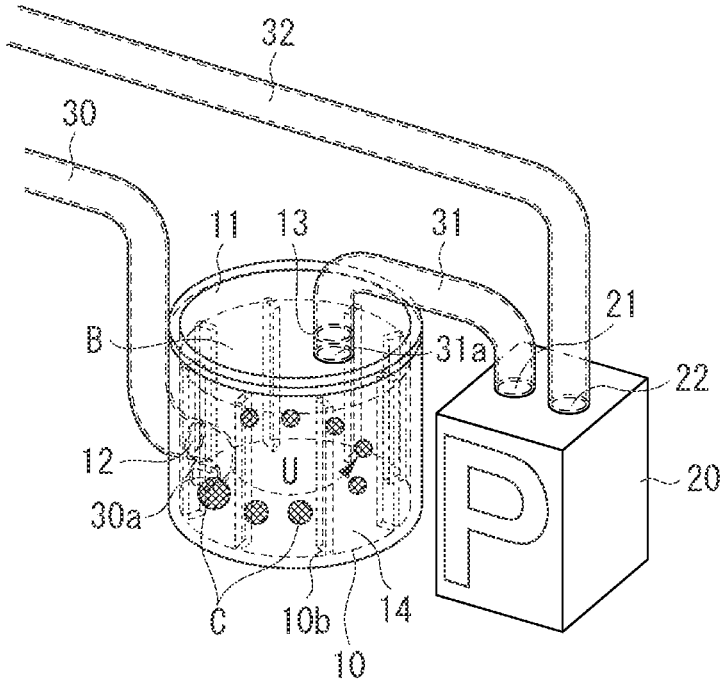

FIGS. 10A and 10B illustrate other examples. As shown in FIG. 10A, the inside of the liquid container 10 has a cylindrical shape. From the end part 30*a* of the conduit 30, the bubbles C are discharged in a direction the bubbles C circulate along the cylindrical shape as shown by the arrow T. The discharged bubbles are broken into small bubbles while the bubbles float up along the vortex. By the above configuration, the efficiency of the filter for trapping the ink mist and the foreign materials increases. FIG. 10B illustrates a modification of the filter in FIG. 10A. The inside of the liquid container 10 has a cylindrical shape, and a plurality of projections 10*b* (for example, ribs) is provided. The bubbles C that spirally move as shown by the arrow U collide with the projections 10*b* and are broken into much smaller bubbles.

Figure 11:
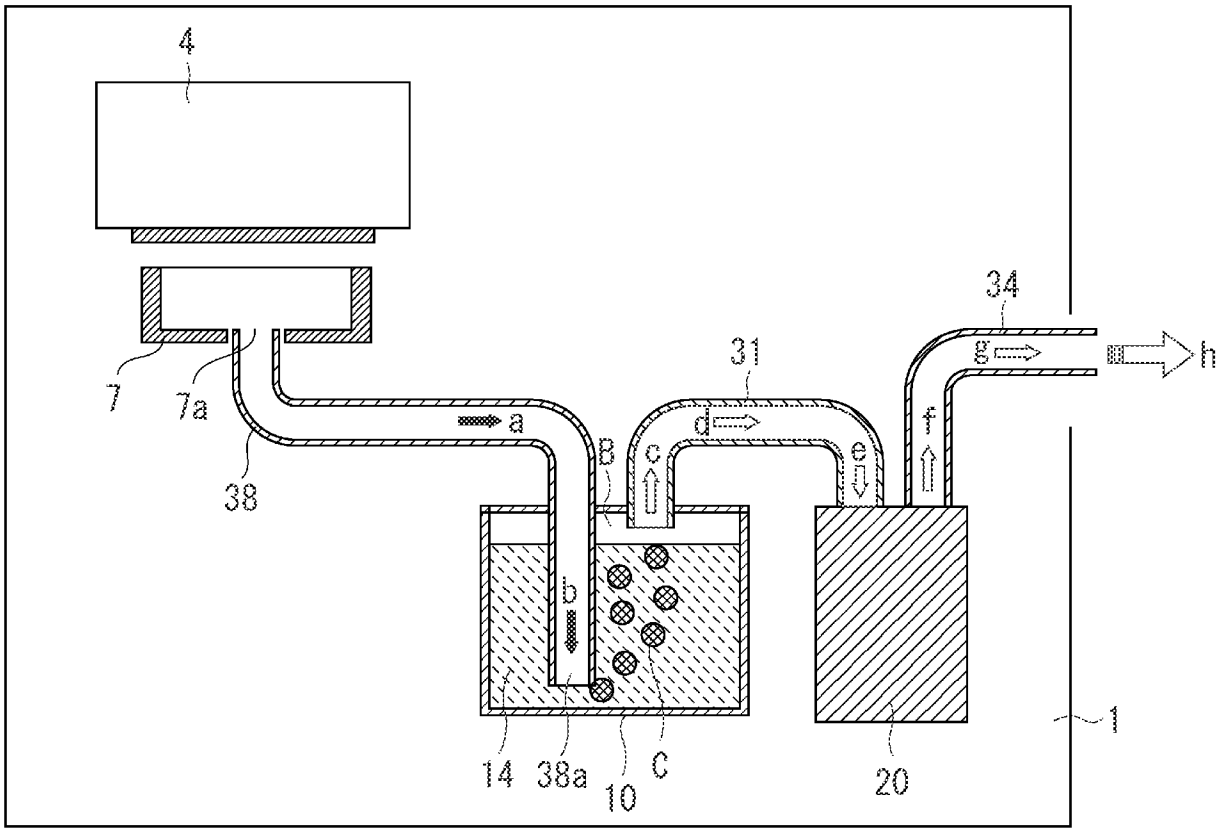
FIG. 11 illustrates a configuration of an inkjet apparatus according to a second exemplary embodiment of the present invention.

A second exemplary embodiment of the present invention is described with reference to FIG. 11. In the above-described examples, the ink mist generated in the housing 2 is filtered by the liquid filter. On the other hand, in the second exemplary embodiment, a receiving member that receives unnecessary ink generated from the inkjet head is provided. The ink and gas is sucked in from the receiving member by reducing the pressure, and thereby dissolving the ink and gas in the liquid. The receiving member is a cap that covers the nozzles of the inkjet head when the inkjet head is not used.

As the receiving member of the unnecessary ink, a cap 7 that covers the nozzles of the inkjet head 4 is provided such that the cap 7 is opposed to the inkjet head 4. The cap 7 can be switched between two states i.e., a state the cap 7 covers the inkjet head 4 when the inkjet head 4 is not used and a state the cap 7 does not cover the inkjet head 4 when the inkjet head 4 is being used. In the vicinity of the cap 7, a platen is also provided similarly to the above-described exemplary embodiment.

Within the cap 7, an ink absorber is provided. The ink absorber is provided to efficiently hold the ink remaining in the cap without leak. In the bottom part of the cap 7, an outlet 7*a* is provided. From the outlet 7*a*, the ink being absorbed in the ink absorber is discharged. The one end of a conduit 38 is connected to an outlet 8*a* and the other end part 38*a* of the conduit 38 opens in the vicinity of the bottom of the liquid 14 in the liquid container 10. More specifically, by the conduit 38, the ink in the ink absorber 9 and gas is discharged into the liquid at a position lower than the liquid level in the liquid container 10. The pump 20, the conduit 31, and the conduit 34 are similar to those described in the FIG. 2. Accordingly, descriptions of the pump 20, the conduit 31, and the conduit 34 are omitted. Each of the above-described units is placed in the inside (first space) of the housing of the recording unit 1. Similarly to the above-described exemplary embodiment, the liquid container 10 and the pump 20 can be placed outside the recording unit 1.

When the pump 20 is operated in a state the cap 7 is not covering the inkjet head 4, the second space above the liquid level in the liquid container 10 is placed in a reduced pressure condition as compared to the first space, and the gas is sucked in from the first space through the ink absorber in the cap 7. The ink mist suspended in the gas is trapped by the ink absorber, and integrated in the already absorbed ink. The ink accumulated in the ink absorber is sucked into the conduit 38 together with the gas, and is discharged into the liquid 14 in the liquid container 10. The discharged ink dissolves in the liquid and the discharged gas becomes bubbles, and thereafter floats up. A part of the ink mist is not trapped by the ink absorber, but passes through the interstices, and is directly sucked into the conduit 38 as the ink mist. However, as described above, the ink mist is trapped by the liquid while the ink mist floats up in the liquid as the bubbles.

When the pump 20 is operated in a state the cap 7 is covering the inkjet head 4, the second space becomes the reduced pressure condition as compared to the first space, and the inside of the cap 7 is placed in the reduced pressure condition. Due to the condition, the ink suction for resolving the discharge failure such as clogging of the nozzles of the inkjet head 4 is performed. The sucked ink passes through the conduit 38, and is discharged into the liquid 14 in the liquid container 10.

Figure 12:
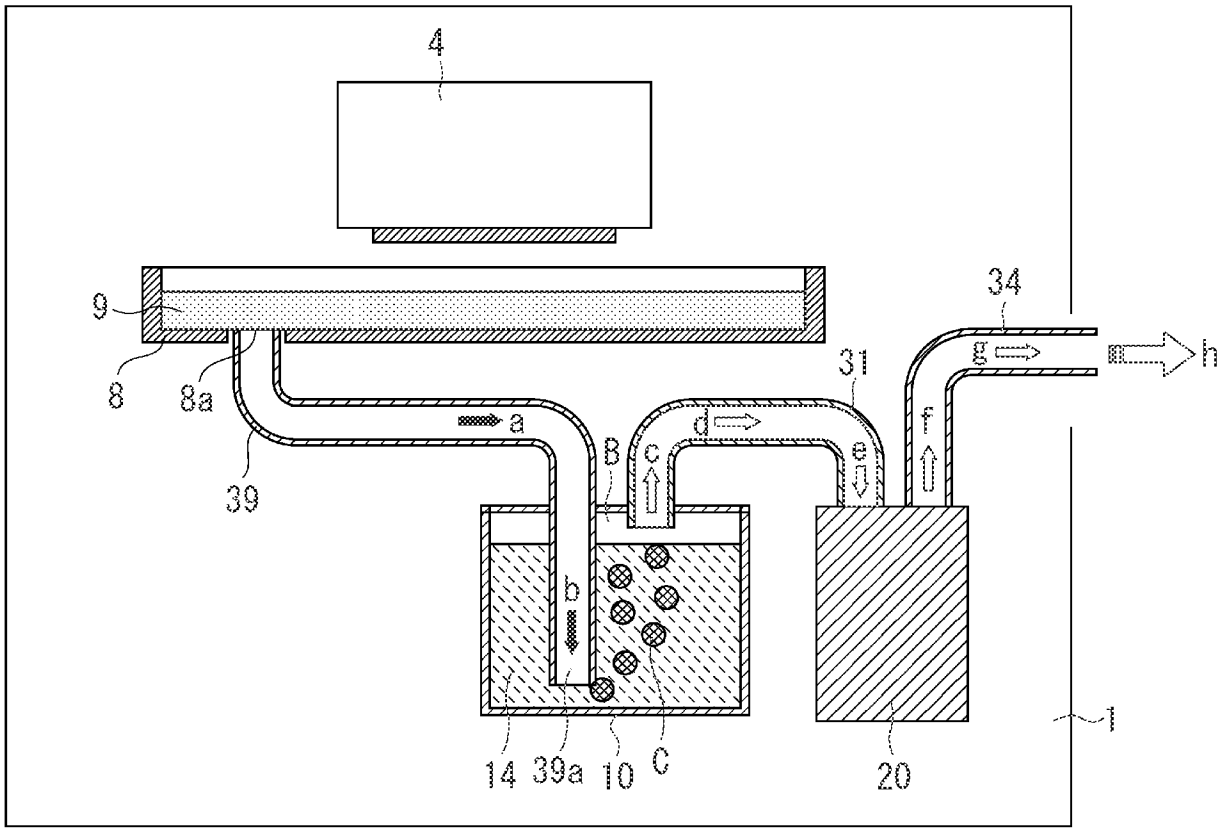
FIG. 12 illustrates a configuration of an inkjet apparatus according to a third exemplary embodiment of the present invention.

A third exemplary embodiment of the present invention is described with reference to FIG. 12. Similarly to the second exemplary embodiment, a receiving member that receives unnecessary ink generated from the inkjet head is provided. The ink and gas is sucked in from the receiving member by reducing the pressure, thereby dissolving the ink and gas in the liquid. However, the point that is different from the second exemplary embodiment is that the receiving member is an absorber that absorbs unnecessary ink discharged form the inkjet head.

The platen 8 that supports the medium 3 is provided opposed to the inkjet head 4. An ink absorber 9 is held in the platen 8, as the receiving member of the unnecessary ink. The ink absorber 9 is provided to absorb the unnecessary ink discharged toward directions other than the medium 3 from the inkjet head 4. An outlet 8*a* is provided in the bottom part of the platen 8. The absorbed ink in the ink absorber 9 is discharged from the outlet 8*a*. The one end of a conduit 39 is connected to the outlet 8*a* and the other end part 39*a* of the conduit 39 opens in the vicinity of the bottom of the liquid 14 in the liquid container 10. More specifically, by the conduit 39, the ink in the ink absorber 9 and gas is discharged into the liquid at a position lower than the liquid level in the liquid container 10. The pump 20, the conduit 31, and the conduit 34 are similar to those in FIG. 2. Accordingly, descriptions of the pump 20, the conduit 31, and the conduit 34 are omitted. Each of the above-described units is placed in the inside (first space) of the housing of the recording unit 1. Similarly to the above-described exemplary embodiment, the liquid container 10 and the pump 20 can be placed outside the recording unit 1.

When the pump 20 is operated, the second space above the liquid level in the liquid container 10 is placed in a reduced pressure condition as compared to the first space, and the gas in the first space is sucked in through the ink absorber 9. The ink mist suspended in the gas is trapped by the ink absorber 9, and integrated in the already absorbed ink. The ink accumulated in the ink absorber 9 is sucked into the conduit 39 together with the gas, and is discharged into the liquid 14 in the liquid container 10. The discharged ink dissolves in the liquid, the discharged gas becomes bubbles, and floats up. A part of the ink mist is not trapped by the ink absorber 9, passes through the interstices, and directly sucked into the conduit 39 as the mist. However, as described above, when the ink mist floats up in the liquid as the bubbles, the ink mist is trapped by the liquid.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-151172 filed Jul. 1, 2010, which is hereby incorporated by reference herein in its entirety.

What is claimed is:

1. An apparatus comprising:

a liquid container storing liquid having a liquid level;

a conduit, having a discharge end placed below the liquid level, configured to discharge gas of a first space where an inkjet head is placed, into the liquid stored in the liquid container; and a pump configured to discharge gas from a second space located above the liquid level in the liquid container, wherein when the pump is operated, the second space becomes a reduced pressure condition as compared to the first space, and the gas of the first space is discharged from the discharge end into the liquid through the conduit, thereby the gas becomes bubbles that float up in the liquid under the liquid level.

2. The apparatus according to claim 1, further comprising:

a return conduit configured to introduce the gas discharged from the second space by the pump into the first space.

3. The apparatus according to claim 2, further comprising:

a humidification unit configured to generate humidified gas, and a unit configured to supply the generated humidified gas in the vicinity of nozzles of the inkjet head, wherein the return conduit is connected to the humidification unit.

4. The apparatus according to claim 1, wherein the gas discharged by the pump is discharged outside a housing providing the first space.

5. The apparatus according to claim 4, wherein a location where the conduit is introduced into the liquid container is lower than a location of an outlet of the housing providing the first space in the direction of gravitational force, and the outlet is disposed higher than the liquid level of the liquid in the direction of gravitational force.

6. The apparatus according to claim 5, wherein the conduit has a shape descending from the position of the outlet to the position to be introduced into the liquid container, without a horizontal part and an ascending part with respect to the direction of gravitational force.

7. The apparatus according to claim 6, wherein the liquid container includes a structure configured to control the bubbles floating up or agitate the bubbles to reduce the size of the bubbles.

8. The apparatus according to claim 1, wherein a housing providing the first space includes a recording unit configured to record on an object by the inkjet head.

* * * * *